US009623422B2

(12) United States Patent
Overdahl

(10) Patent No.: US 9,623,422 B2
(45) Date of Patent: Apr. 18, 2017

(54) ELECTROFILTER FOR THE PURIFICATION OF SMOKE FROM IN PARTICULAR MINOR STRAW BOILERS

(71) Applicant: Jorgen Overdahl, Hjallerup (DK)

(72) Inventor: Jorgen Overdahl, Hjallerup (DK)

(73) Assignee: OVERDAHL ELECTRO FILTERS APS, Hjallerup (DK)

( * ) Notice: Subject to any disclaimer, the term of this patent is extended or adjusted under 35 U.S.C. 154(b) by 0 days.

(21) Appl. No.: 14/382,622

(22) PCT Filed: Oct. 16, 2013

(86) PCT No.: PCT/DK2013/000068

§ 371 (c)(1),
(2) Date: Sep. 3, 2014

(87) PCT Pub. No.: WO2014/079447

PCT Pub. Date: May 30, 2014

(65) Prior Publication Data

US 2015/0246363 A1 Sep. 3, 2015

(30) Foreign Application Priority Data

Nov. 23, 2012 (DK) ..... 2012 73923

(51) Int. Cl.
*B03C 3/76* (2006.01)
*B03C 3/47* (2006.01)
(Continued)

(52) U.S. Cl.
CPC ..... *B03C 3/76* (2013.01); *B03C 3/08* (2013.01); *B03C 3/41* (2013.01); *B03C 3/47* (2013.01); *F23J 15/02* (2013.01); *B03C 2201/04* (2013.01)

(58) Field of Classification Search
CPC combination set(s) only.
See application file for complete search history.

(56) References Cited

U.S. PATENT DOCUMENTS 1,394,771 A * 10/1921 Kennard ..... B03C 3/10 96/40
2,631,687 A * 3/1953 Dohrer ..... B03C 3/10 55/430

(Continued)

FOREIGN PATENT DOCUMENTS

| | | | | |
|---|---|---|---|---|
| FR | 1297911 A | | 7/1962 | |
| GB | 368091 A | | 3/1932 | |
| GB | 987220 A | * | 3/1965 | ..... B03C 3/76 |

OTHER PUBLICATIONS

International Search Report dated Feb. 14, 2014, corresponding to International Patent Application PCT/DK2013/000068.

*Primary Examiner* — Duane Smith
*Assistant Examiner* — Sonji Turner
(74) *Attorney, Agent, or Firm* — Ladas & Parry LLP

(57) ABSTRACT

An electrofilter for smoke purification having a set of mutually parallel positive electrodes, which form a number of mutually parallel ducts through which the smoke to be purified can pass and by a set of negative electrodes, which are suspended midway between the collection plates, the collection plates are designed as circular plates mounted at a uniform mutual distance on a rotating shaft, and the discharge wires are suspended from a common frame on which a vibrator is mounted which can vibrate and thus clean the discharge wires of collected dust. On the frame of the electrofilter between each collection plate, stationary scrapers are mounted which bear against each collection plate and clean them of dust.

6 Claims, 6 Drawing Sheets

(51) Int. Cl.

| | |
|---|---|
| ***B03C 3/08*** | (2006.01) |
| ***B03C 3/41*** | (2006.01) |
| ***F23J 15/02*** | (2006.01) |

(56) References Cited

U.S. PATENT DOCUMENTS 3,929,436 A * 12/1975 Kim ..... B03C 3/743 96/51
4,000,994 A * 1/1977 Youhouse ..... B03C 3/10 55/429
4,221,573 A 9/1980 Hankins
4,284,420 A * 8/1981 Borysiak ..... B03C 3/743 96/40
4,539,022 A * 9/1985 McLoughlin ..... B03C 3/10 96/40
4,823,549 A * 4/1989 Moser ..... F01N 3/01 55/296
4,932,985 A * 6/1990 Jonelis ..... B03C 3/761 173/131
5,084,077 A * 1/1992 Junker ..... B03C 3/10 96/39
5,429,669 A * 7/1995 Chang ..... B03C 3/743 95/76
6,336,961 B1 * 1/2002 Terai ..... B03C 3/66 96/20
7,241,330 B2 * 7/2007 Moshenrose ..... B03C 3/08 95/57
7,641,718 B2 * 1/2010 Furuta ..... B03C 3/08 95/75
8,257,469 B2 * 9/2012 Meister ..... B03C 3/41 55/DIG. 38
2006/0086250 A1 * 4/2006 Moshenrose ..... B03C 3/08 96/86
2009/0007788 A1 * 1/2009 Arye ..... B03C 3/47 96/40
2009/0056551 A1 * 3/2009 Furuta ..... B03C 3/08 96/87
2010/0236412 A1 * 9/2010 Meister ..... B03C 3/41 96/28

* cited by examiner

PRIOR ART

ELECTROFILTER FOR THE PURIFICATION OF SMOKE FROM IN PARTICULAR MINOR STRAW BOILERS

This application is a 371 of PCT/DK2013/000068, filed on Oct. 16, 2013, which claims priority to Danish Application No. PA20120073923, filed Nov. 23, 2012.

The present invention relates to an electrofilter which consists in principle of two respectively positive and negative electrodes which are connected to a high voltage source. The type of voltage is normally a pulsating direct voltage generated by rectifying single-phased alternating voltage. The voltage level is 20 to 100 kV, depending on the size and design of the filter.

The positive electrodes of the electrofilter consists normally of steel plates, so-called collection plates, suspended at a mutual distance of 100 to 400 mm, whereby parallel ducts are created between the plates through which the smoke to be purified passes in a horizontal flow. For safety reasons the collection plates are always earthed, see FIG. 2.

The negative electrodes, so-called discharge wires, can be either thin wires, springs or rods suspended midway between the collection plates.

When the voltage between the discharge wires and the collection plates is sufficiently high, the discharge wires will begin emitting electrons which will immediately move towards the positive collection plates. On the way the electrons will ionize the air molecules which will then be attracted by the neutral dust particles whereby these become negatively charged and attracted by the collection plates, see FIG. 2.

The dust particles from the smoke will little by little settle as a layer on the collection plates. The layer thickness will be largest at the inlet and will diminish exponentially in the longitudinal direction of the filter. Usually the dust layer is subsequently removed from the collection plates by knocking on these with hammers or vibrators.

This frees the dust which falls down into dust hoppers underneath the collection plates. As the electric current runs from the discharge wires towards the collection plates, the collected dust must have some conducting capacity if the process is to continue unhindered with dust-coated collection plates.

The conducting capacity is most often expressed by the resistivity which can be determined experimentally. If the resistivity in the collected dust is above a certain value, a relatively high voltage drop will occur above the dust layer on the collection plates.

If this voltage drop exceeds a certain level, the air molecules between the particles in the dust layer will be ionized, and the dust layer will begin emitting positive ions which will move towards the discharge wires and neutralize the negative ions. This will cause the corona current to increase drastically, and the filtering effect will drop catastrophically. This phenomenon is called reverse flow. In large coal-fired stations the problem can be reduced by continuously adding water or chemical compounds to the flue gas, which will improve the conducting capacity of the dust. In minor straw boilers this is not realistic.

It is the purpose of the present invention to describe an electrofilter that can be used to purify the smoke from especially minor straw boilers.

This is achieved by designing the electrofilter as described herein. Thereby, reverse flow is prevented, and the filtering effect can be maintained without continuously adding water or chemicals to the flue gas.

The present application describes the design of the cutouts in the collection plates in an electrofilter according to the invention.

The present application also describes an alternative design of the cutouts in the collection plates in an electrofilter according to the invention.

With the present design, a cutting effect will be obtained at temperature fluctuations in a collection plate that can break up any lumps of dust that may have collected in the cutouts.

The present application further describes a third design of the cutouts in the collection plates of an electrofilter according to the invention.

With the design described in claim 6 the shape stability of the collection plates is further improved.

The invention is explained in detail below with reference to the drawing, in which FIG. 1 is a known electrofilter, FIG. 2 shows the purification principle of the electrofilter shown in FIG. 1, FIG. 3 is a perspective and partial section view of an electrofilter with rotating collection plates, FIG. 4 is a side view of an electrofilter with rotating collection plates FIG. 5 shows a drawing corresponding to the drawing shown in FIG. 4, viewed from one end and with the discharge wires in drawn out position, FIG. 6 shows a rotating collection plate in which each quadrant is designed with cutouts shaped as parts of circular rings which are mutually offset at the transition from one quadrant to the next.

Figure 1:
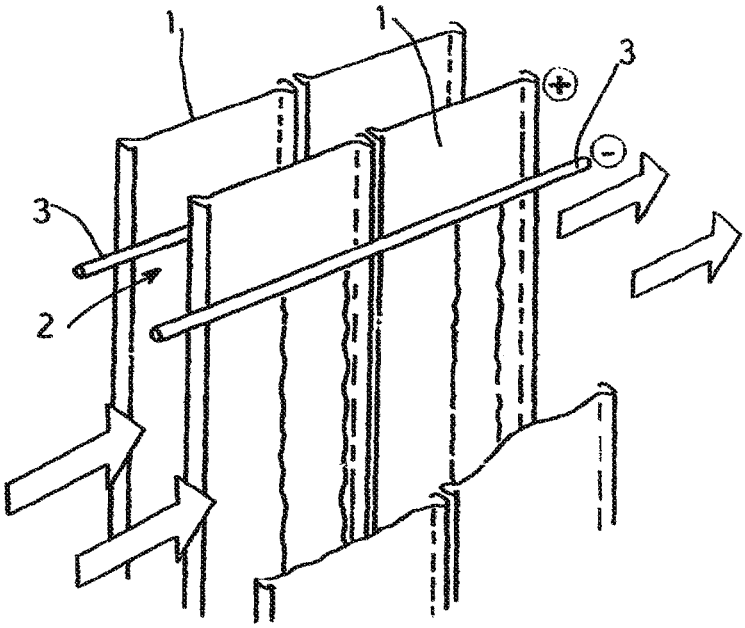
Figure 2:
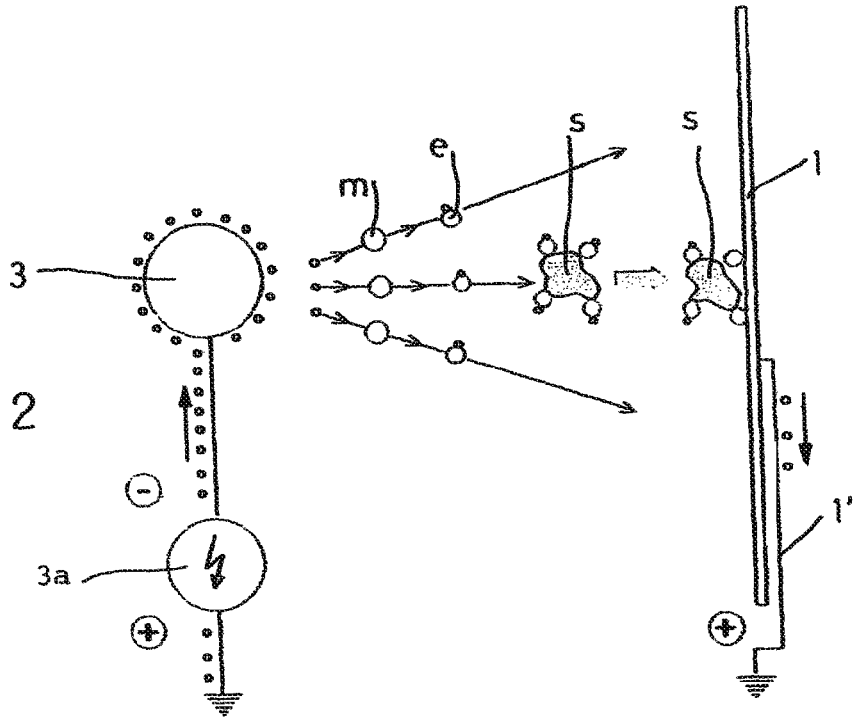
PRIOR ART FIG. 2

When the voltage between the discharge wires and the collection plates is sufficiently high, the discharge wires will start emitting electrons e, which will immediately move towards the positive collection plates 1 which are earthed by a wire 1'. This is called corona charging. On the way the electrons e will ionize the air molecules m, which will then be attracted by the neutral dust particles s whereby these become negatively charged and attracted by the collection plates, see FIG. 2.

Figure 3:
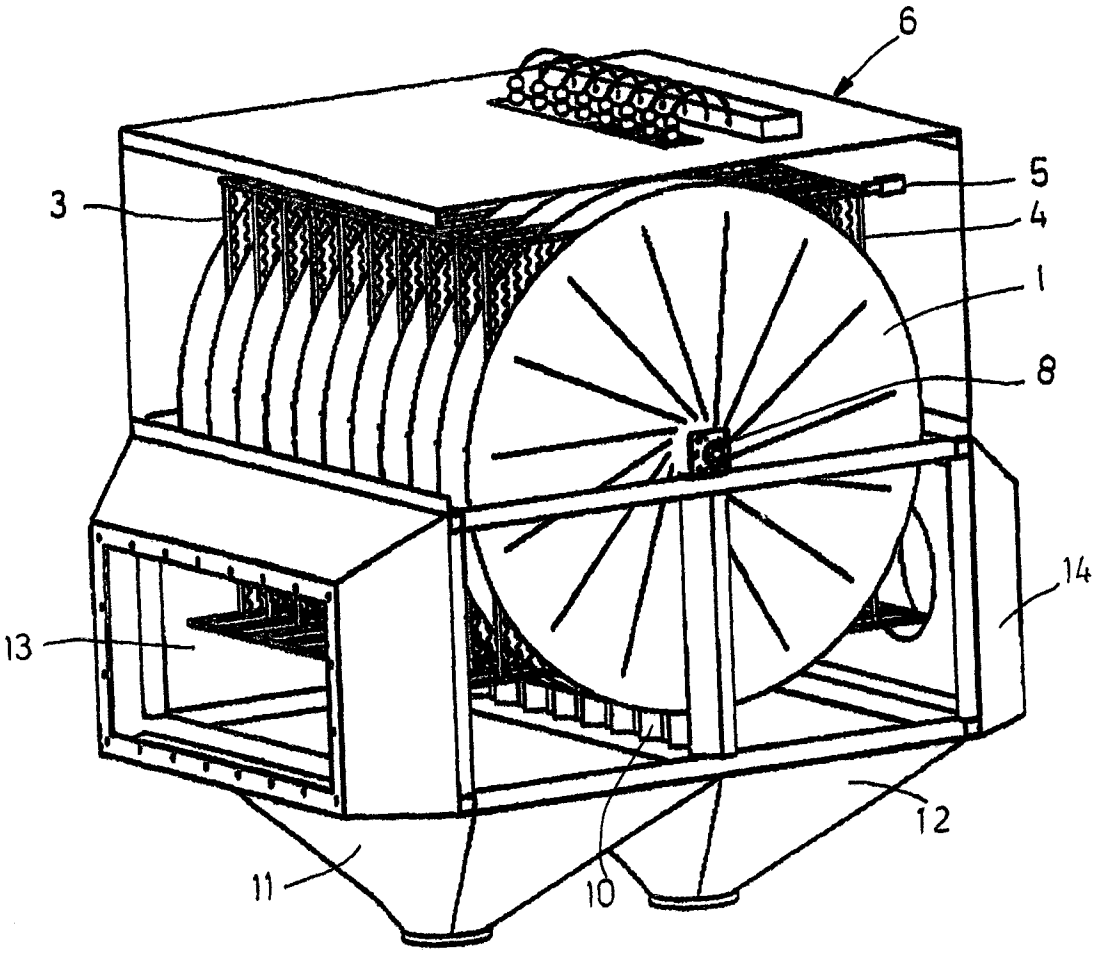
Figure 5:
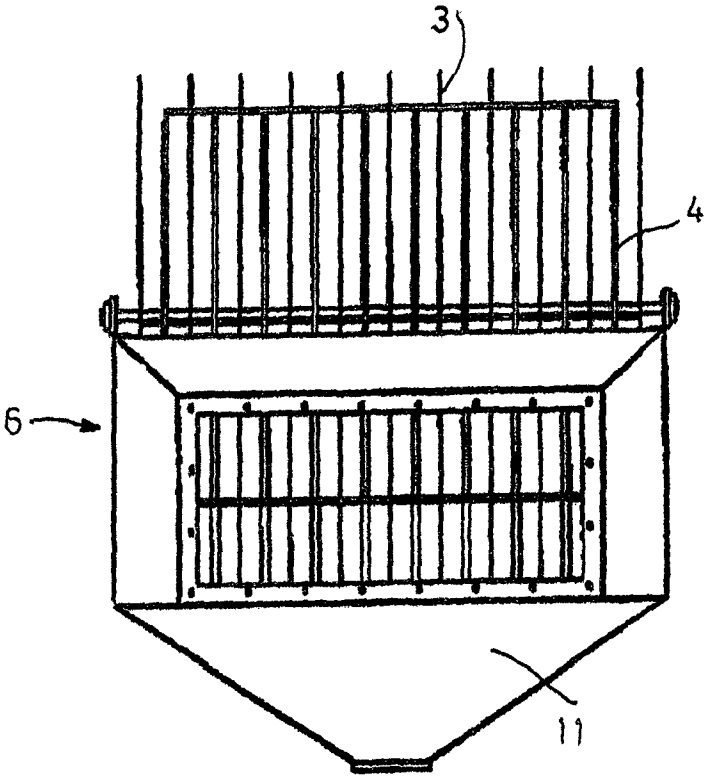
Figure 4:
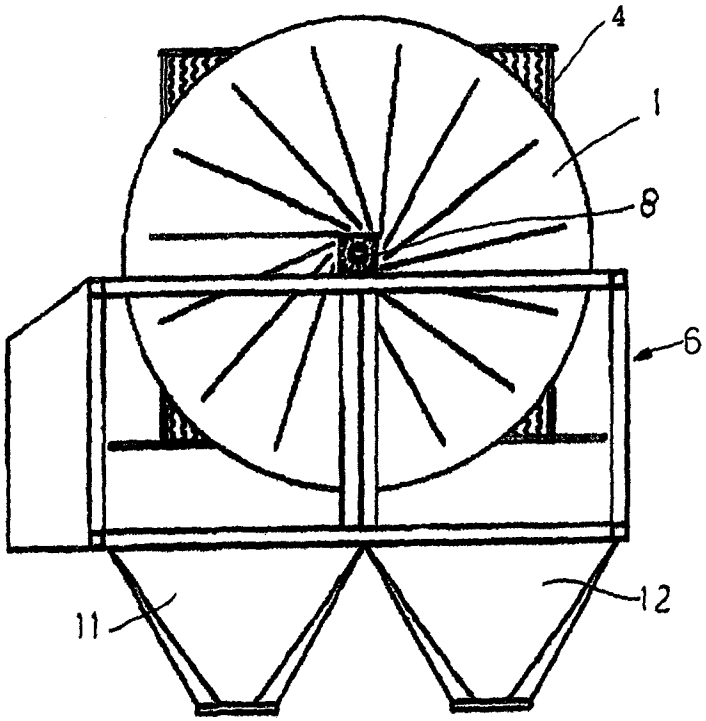

As shown in FIGS. 3 and 4 an electrofilter 6 according to the invention is designed with a row of, by way of example eleven, rotating circular collection plates 1 mounted at a uniform mutual distance on a rotating shaft 8. Between each collection plate 1 and a neighbouring plate discharge wires are placed which can be mounted on a frame 4, on which a vibrator 5 is mounted that can clean the discharge wires 3 of dust. Moreover, the electrofilter 6 is fitted with stationary scrapers 10 which bear against each of the rotating collection plates 1 and clean them of dust, which drops into hoppers 11 and 12 below. The gas to be purified is led into the electrofilter through an entry hole 13 and after purification out through an exit hole 14.

Figure 6:
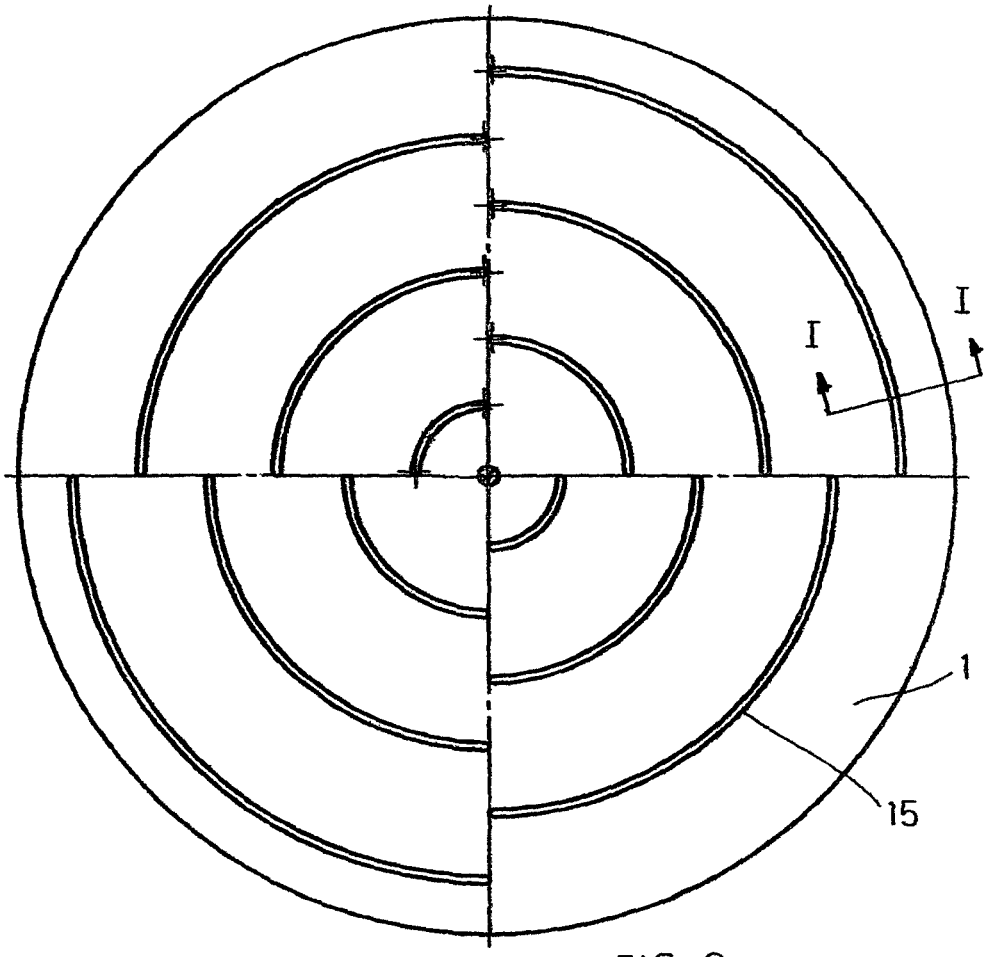
Figure 7:
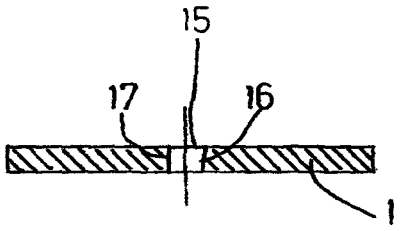
FIG. 7 shows a sectional view following the line I-I in FIG. 6.
Figure 8:
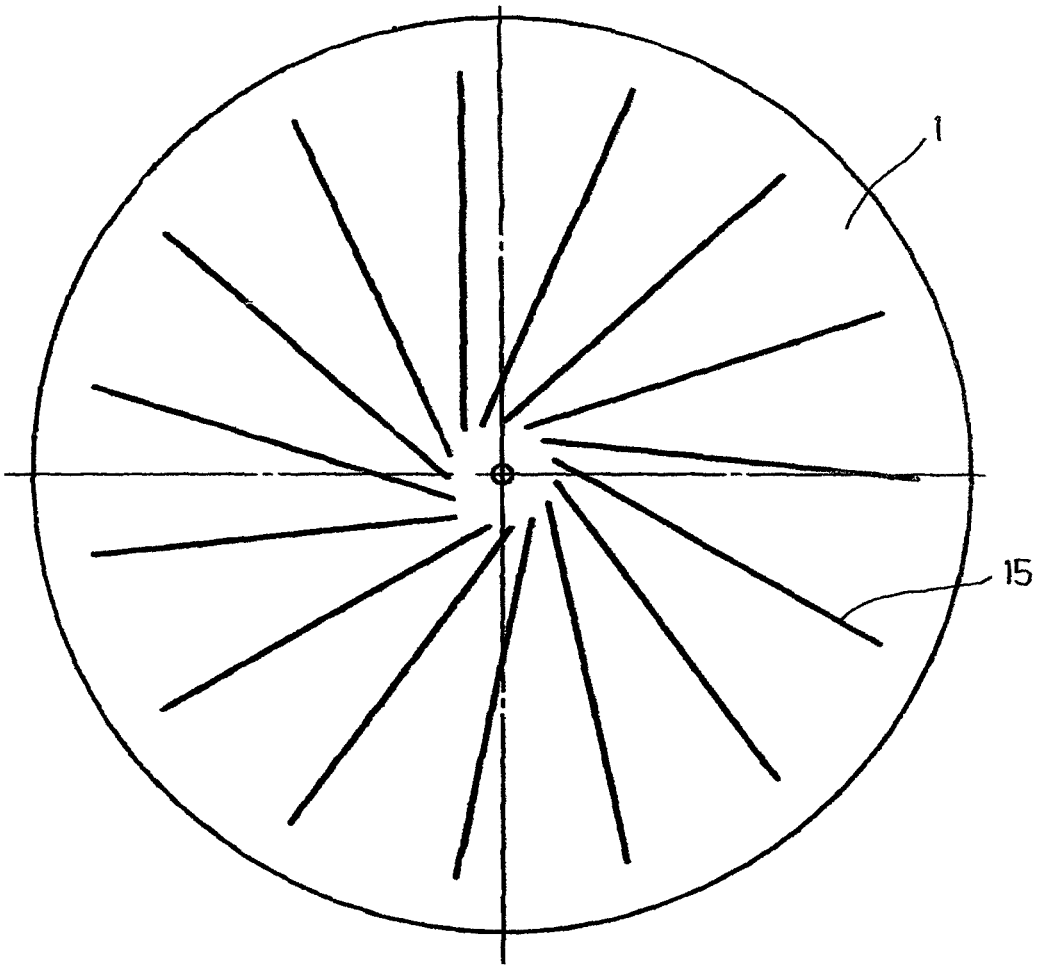
FIG. 8 shows a rotating collection plate with rectilinear, approximately radial cutouts.

As shown in FIGS. 6 and 8 the rotating collection plates 1 are designed with cutouts 15, which can be circular as shown in FIG. 6 or rectilinear and approximately radial as shown in FIG. 8. As shown in FIG. 7 one side 16 of a cutout can be slightly inclined in relation to the other side 17 which is perpendicular to the surface of the collection plate 1. This way a cutting effect can be obtained at temperature fluctuations in a collection plate 1, which can break up any lumps of dust that may have collected in the cutouts.

Figure 9:
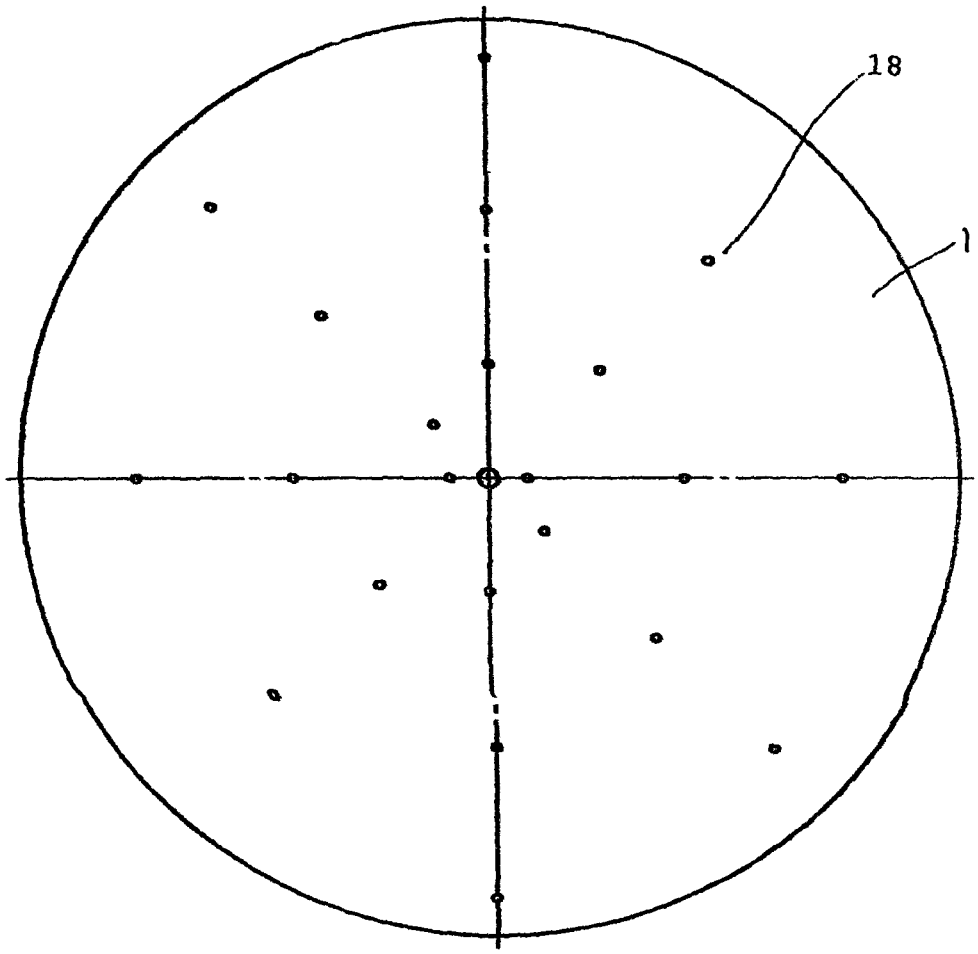
FIG. 9 shows a rotating collection plate in which the cutouts are shaped as through bores.

As shown in FIG. 9 the collection plates 1 may also be designed with rows of through bores 18 instead of cutouts.

The cutouts may also be shaped otherwise than shown in FIGS. 6 and 8.

Designing the collection plates with cutouts or through bores has the effect that the collection plates do not shrink and/or buckle at temperature fluctuations. Thus the desired and necessary cleaning effect can be obtained if stationary scrapers are used. To make it even more certain that the collection plates 1 will not buckle, guide rollers not shown in the drawing are mounted at each collection plate.

The invention claimed is:

1. An electrofilter for smoke purification consisting of several sets of positive collection plates and negative discharge wires, wherein the collection plates comprise steel plates which are earthed by a wire and fixed in parallel at a mutual distance of 100 to 400 mm, whereby parallel ducts are created between the collection plates through which the smoke to be purified passes in a horizontal flow, and the negative discharge wires are suspended midway between the collection plates, wherein the electrofilter is designed with a row of circular collection plates which are mounted at a uniform mutual distance on a rotating shaft, wherein, between each collection plate and a neighbouring plate, one or more discharge wires are mounted, which are suspended from a common frame on which a vibrator is mounted, which can vibrate and clean the discharge wires of collected dust, wherein, on a frame of the electrofilter, between each pair of collection plates, stationary scrapers are mounted for each of the collection plates which bear against and are able to clean the collection plates of dust, and wherein each of the collection plates is designed with evenly distributed cutouts, or through bores which can absorb any shear, expansion, or contraction of the collection plates owing to temperature fluctuations, so that the collection plates remain fully or approximately plane in operation, and wherein, at each collection plate, guide rollers are mounted that bear against the collection plate and keep this plane to ensure an efficient scraping process.

2. The electrofilter according to claim 1, wherein the evenly distributed cutouts are shaped as parts of circular rings which are mutually displaced in each quadrant.

3. The electrofilter according to claim 1, wherein the evenly distributed cutouts are rectilinear and approximately radial.

4. The electrofilter according to claim 2, wherein one side of a cutout of the evenly distributed cutouts is slightly inclined in relation to the other side of the cutout of the evenly distributed cutouts, which is perpendicular to the surface of the collection plate.

5. The electrofilter according to claim 1, wherein the evenly distributed cutouts are shaped as a row of through bores which can have a conical cross section.

6. The electrofilter according to claim 1, wherein the guide rollers are mounted so that they bear against the periphery of each collection plate.

* * * * *